US008720572B2

(12) United States Patent
Lerner et al.

(10) Patent No.: US 8,720,572 B2
(45) Date of Patent: May 13, 2014

(54) HIGH PRESSURE FAST RESPONSE SEALING SYSTEM FOR FLOW MODULATING DEVICES

(75) Inventors: Daniel Maurice Lerner, Missouri City, TX (US); Gabor Vecseri, Houston, TX (US); David John Kusko, Houston, TX (US)

(73) Assignee: Teledrill, Inc., Katy, TX (US)

( * ) Notice: Subject to any disclaimer, the term of this patent is extended or adjusted under 35 U.S.C. 154(b) by 644 days.

(21) Appl. No.: 12/316,863

(22) Filed: Dec. 17, 2008

(65) Prior Publication Data

US 2010/0147525 A1 Jun. 17, 2010

(51) Int. Cl.
*E21B 34/06* (2006.01)

(52) U.S. Cl.
USPC ..... 166/332.1; 166/386; 166/387; 166/316; 166/319; 367/85

(58) Field of Classification Search
USPC ..... 166/386, 387, 376, 316, 319, 332.1; 277/329, 338, 518; 367/83–85
See application file for complete search history.

(56) References Cited

U.S. PATENT DOCUMENTS

| | | | | |
|---|---|---|---|---|
| 4,386,422 | A * | 5/1983 | Mumby et al. | 367/85 |
| 4,742,498 | A | 5/1988 | Barron | |
| 4,905,778 | A | 3/1990 | Jurgens | |
| 5,040,155 | A | 8/1991 | Feld et al. | |
| 5,103,430 | A | 4/1992 | Jeter et al. | |
| 5,117,398 | A | 5/1992 | Jeter | |
| 5,250,806 | A | 10/1993 | Rhein-Knudson et al. | |
| 5,402,068 | A | 3/1995 | Meador et al. | |

(Continued)

FOREIGN PATENT DOCUMENTS

| | | | |
|---|---|---|---|
| EP | 0781422 | B1 | 4/2000 |
| EP | 0681090 | A2 | 12/2002 |

(Continued)

*Primary Examiner* — James Sayre
(74) *Attorney, Agent, or Firm* — Guerry L. Grune; ePatentManager.com

(57) ABSTRACT

Disclosed is an apparatus, method and system comprising one or more devices capable of modulating fluid flow, the fluid being a liquid or a gas resulting in a pressure fluctuation in a fluid flowing within a flow channel, comprising: a flow modulating device that acts as a servo valve such that the device comprises a shaft and a moveable actuator that slides along the shaft, wherein the shaft and the actuator are positioned at any angle within a principal fluid flow channel such that the fluid flows through the principal fluid flow channel. The fluid flowing within the principal fluid flow channel is selectively reversible and the fluid is connected to both an inner pilot flow channel and the principal fluid flow channel wherein the flow modulating device includes a particulate barrier system having at least one seal system comprising an upper outer seal and a lower outer seal prohibiting fluid particulates from entering the inner pilot flow channel and also includes an upper inner seal and a lower inner seal that further prohibit residual particulates from reaching any mating surface between the shaft of the flow modulating device and the upper seal, the upper inner seal, the lower outer seal, and the lower inner seal. The particulate barrier system operates in a fluid flow field wherein the fluid can flow in any direction and utilizes a sealing system wherein an upper outer seal and a lower outer seal prohibit particulates from reaching the respective surfaces of an upper inner seal and lower inner seal of the flow modulating device. An upper inner seal and lower inner seal further prohibit residual particulates from reaching surfaces between the seal and that of the shaft of the flow modulating device.

36 Claims, 5 Drawing Sheets

(56) References Cited

U.S. PATENT DOCUMENTS

| | | | |
|---|---|---|---|
| 5,461,230 | A | 10/1995 | Winemiller |
| 5,467,832 | A | 11/1995 | Orban et al. |
| 5,473,579 | A | 12/1995 | Jeter |
| 5,517,464 | A | 5/1996 | Lerner et al. |
| 5,802,011 | A | 9/1998 | Winters et al. |
| 5,804,820 | A | 9/1998 | Evans et al. |
| 5,836,353 | A | 11/1998 | Van Steenwyk |
| 5,901,113 | A | 5/1999 | Masak et al. |
| 6,002,643 | A | 12/1999 | Tchakarov et al. |
| 6,016,288 | A | 1/2000 | Frith |
| 6,057,784 | A | 5/2000 | Schaaf et al. |
| 6,220,371 | B1 | 4/2001 | Sharma et al. |
| 6,300,624 | B1 | 10/2001 | Yoo et al. |
| 6,583,621 | B2 | 6/2003 | Prammer et al. |
| 6,714,138 | B1 | 3/2004 | Turner et al. |
| 7,180,826 | B2 * | 2/2007 | Kusko et al. ..... 367/85 |
| 2004/0089475 | A1 | 5/2004 | Kruspe et al. |

FOREIGN PATENT DOCUMENTS

| | | | |
|---|---|---|---|
| GB | 2157345 | A | 10/1985 |
| WO | WO00/57211 | A1 | 9/2000 |
| WO | WO2004/044369 | A2 | 11/2004 |
| WO | WO2010/071621 | A1 | 6/2010 |

* cited by examiner

HIGH PRESSURE FAST RESPONSE SEALING SYSTEM FOR FLOW MODULATING DEVICES

FIELD OF DISCLOSURE

This disclosure relates to modulating fluid flow using flow modulating devices (FMD) for fluids containing particulates and accompanying accumulation that may eventually jam the mechanical action of these devices. Specifically, special seals have been designed to ensure the flow device is a flow modulator that can act as a flow throttling device (FTD) and function as a down hole pulser for drilling and rate of penetration enhancement while also being used to send measurement while drilling (MWD) signals. The flow modulator can also be used as a pulser for fracturing, for seismic pulse generation, tertiary recovery wave generation and other various valve applications.

BACKGROUND OF DISCLOSURE

U.S. Pat. No. 7,180,826, U.S. Patent Publication US2008/0179093A1 and pending U.S. patent application Ser. No. 12/004,121 are herein fully incorporated by reference as describing a flow throttling device (FTD) for use in signaling applications using pressure pulses in a constrained, moving fluid column. The FTD uses hydraulic power from the moving drilling fluid to actuate the FTD against the moving fluid column. A fraction of the drilling fluid is utilized in a pilot valve to control the FTD, resulting in greatly reduced energy required to operate the FTD.

The FTD is a fast acting, high pressure, dynamic modulating valve. As such, the instantaneous forces on the mechanism are stressful. The FTD has a large operating range from several pounds to thousands of pounds of pressure drop. It is able to actuate in milliseconds, and modulate the pressure accurately. These features place a high demand on the seals which must have both low friction for the low pressure operating range, and high strength for the high pressure sealing requirements. Two pairs of seals are used. Outer seals exclude the large particulates. Inner seals support the high pressure operation.

Generally the seals used in FTDs or FMDs are of a single seal design where the seal moves bi-directionally in conjunction with the fluid flow. When the FTD or FMD is used in "clean" fluids, that is fluids containing particulates much smaller than the clearance tolerances of all moving surfaces of the FTD, the operation works in an exemplary fashion.

However, many drilling operations do not have the benefits of "clean" fluids in which to operate. Operations that employ the use of "dirty" fluids which by definition can carry aggregate particles larger or smaller than the tolerance of the moving parts. This includes moving seals, and seats, that contain particulates which contaminate the FTD or FMD actuator from moving along the full travel distance (leaking and not opening fully) or from moving at all (jamming in one of three positions; open, closed, or intermediate).

As FTD or FMD seals are in the process of seating in the presence of dirty fluids, pressure is applied to both sides of the seal area while the seal is moving. This allows for particulates to become trapped in the seal contact area which pushes the particulates together thereby contaminating the seals and contact areas. The compacting action of the moving parts on the "dirty fluid" squeezes the fluid out from the moving parts causing the particulates to wedge across the seal contact area and eventually particulates form a solid ring between the seal and the surface that subsequently jams the FTD or FMD components in both directions.

The lack of proper sealing of the FTD or FMD chambers in the presence of the "dirty fluid" diminishes the clarity of the signal and reliability of the effected seals and contact areas. The present disclosure describes a hydraulically actuated servo valve operating with pressure on both sides of the actuator and a sealing system that allows for reliable bi-directional operation in the presence of "dirty fluid" and is different from other seal applications. The present invention also defines a hydraulically amplified servo valve allowing for pressure to act on both an upper and lower side of the actuator, which has been a key problem that has been overcome with the use of this seal system design and is different than other seal applications of this type.

RELEVANT ART

U.S. Pat. No. 5,040,155 to Feld, et. al. describe a double guided fluid pulse valve that is placed within a tube casing making the valve independent of movement of the main valve body and free of fluctuations of the main valve body. The valve contains a pressure chamber with upwardly angled passages for fluid flow between the pressure chamber and the main valve body. Double guides ensure valve reliability in the horizontal position.

U.S. Pat. No. 5,473,579 to Jeter, et. al., describes a pulser that utilizes a servo valve and spring acting upon each other to urge a signal valve to move axially within a bore with signal assistance coming from a counter balance compensator device.

U.S. Pat. No. 5,117,398 to Jeter describes a pulser device that uses electromagnetically opened latches that mechanically hold the valve in the closed or open position, not allowing movement, until a signal is received and the latches are electronically released.

U.S. Pat. No. 6,002,643 by Tchakarov, et al., describes a pulser device in which a bi-directional solenoid contains a first and second coil and a rod extending within the coils used to actuate a poppet valve creating bi-directional pressure pulses. Orifices to permit the flow of drilling fluid to be acted upon by the piston assembly within the main body of the pulser tool and a pressure actuated switch to enable the electronics of the control device to act upon the pulser tool.

U.S. Pat. No. 4,742,498 to Barron describes a pulser device that has the piston that is acted upon by the drilling fluid and is allowed seating and unseating movement by use of springs and an omni directional solenoid.

U.S. Pat. No. 6,016,288 to Frith discloses a servo driven pulser which actuates a screw shaft which turns and provides linear motion of the valve assembly. All components except the shaft are within a sealed compartment and do not come in contact with the drilling fluid.

U.S. Pat. No. 5,802,011 to Winters, et al., that describes a solenoid driven device that pivots a valve that enters and leaves the annular drilling fluid flow blocking and unblocking the fluid flow intermittently.

U.S. Pat. No. 5,103,430 to Jeter, et al., describes a two chamber pulse generating device that creates fluid chambers above and below a poppet valve that is servo driven. Pressure differential is detected on either side of the poppet through a third chamber and the servo is urged to move the poppet in order to stabilize the pressure differential.

U.S. Pat. No. 5,901,113 to Masak, et al., describes a measurement while drilling tool that utilizes inverse seismic profiling for identifying geologic formations. A seismic signal generator is placed near the drill bit and the generated known signals are acted upon by the geologic formations and then read by a receiver array.

U.S. Pat. No. 6,583,621 B2 to Prammer, et al., describes a magnetic resonance imaging device comprising of a permanent magnet set within a drill string that generates a magnetic flux to a sending antennae that is interpreted up hole.

U.S. Pat. No. 5,517,464 to Lemer, et al., describes a pulse generating device utilizing a flow driven turbine and modulator rotor that when rotated creates pressure pulses.

U.S. Pat. No. 5,467,832 to Orban, et al., describes a method for generating directional downhole electromagnetic or sonic vibrations that can be read up hole utilizing generated pressure pulses.

U.S. Pat. No. 5,461,230 to Winemiller, describes a method and apparatus for providing temperature compensation in gamma radiation detectors in measurement while drilling devices.

U.S. Pat. No. 5,402,068 to Meador, et. al., describes a signal generating device that is successively energized to generate a known electromagnetic signal which is acted upon by the surrounding environment. Changes to the known signal are interpreted as geological information and acted upon accordingly.

U.S. Pat. No. 5,250,806 to Rhein-Knudsen, et al., describes a device wherein the gamma radiation detectors are placed on the outside of the MWD device to physically locate them nearer to the drill collar in order to minimize signal distortion.

U.S. Pat. No. 5,804,820 to Evans, et al., describes a high energy neutron accelerator used to irradiate surrounding formations that can be read by gamma radiation detectors and processed through various statistical methods for interpretation.

U.S. Pat. No. 6,057,784 to Schaaf, et al., describes a measurement while drilling module that can be placed between the drill motor and the drill bit situating the device closer to the drill bit to provide more accurate geological information.

U.S. Pat. No. 6,220,371 B1 to Sharma, et al., describes a downhole sensor array that systematically samples material (fluid) in the drill collar and stores the information electronically for later retrieval and interpretation. This information may be transmitted in real time via telemetry or other means of communication.

U.S. Pat. No. 6,300,624 B1 to Yoo, et al., describes a stationary detection tool that provides azimuth data, via radiation detection, regarding the location of the tool.

U.S. Pat. No. 5,134,285 to Perry, et al., describes a measurement while drilling tool that incorporates specific longitudinally aligned gamma ray detectors and a gamma ray source.

U.S. Application No. 2004/0089475 A1 to Kruspe, et.al., describes a measurement while drilling device that is hollow in the center allowing for the drilling shaft to rotate within while being secured to the drill collar. The decoupling of the device from the drill shaft provides for a minimal vibration location for improved sensing.

U.S. Pat. No. 6,714,138 B1 to Turner, et. al., describes a pulse generating device which incorporates the use of rotor vanes sequentially moved so that the flow of the drilling fluid is restricted so as to generate pressure pulses of known amplitude and duration.

G.B. Application No. 2157345 A to Scott, describes a mud pulse telemetry tool which utilizes a solenoid to reciprocally move a needle valve to restrict the flow of drilling fluid in a drill collar generating a pressure pulse.

International Application Number WO 2004/044369 A2 to Chemali, et.al., describes a method of determining the presence of oil and water in various concentrations and adjusting drilling direction to constantly maintain the desired oil and water content in the drill string by use of measuring fluid pressure. The fluid pressure baseline is established and the desired pressure value is calculated, measured and monitored.

International Publication Number WO 00/57211 to Schultz, et.al., describes a gamma ray detection method incorporating the use of four gamma ray sondes to detect gamma rays from four distinct areas surrounding a bore hole.

European Patent Application Publication Number 0 681 090 A2 to Lerner, et. al., describes a turbine and rotor capable of restricting and unrestricting the fluid flow in a bore hole thereby generating pressure pulses.

European Patent Specification Publication Number EP 0 781 422 B1 to Loomis, et. al. describes utilizing a three neutron accelerator and three detectors sensitive to specific elements and recording device to capture the information from the three detectors.

SUMMARY OF THE DISCLOSURE

Disclosed are seals for a flow modulating device (FMD) or FTD in a fluid environment having particulates forming a particulate barrier system of at least one seal system for an actuator such that an upper outer seal and a lower outer seal acting as wipers or scrapers prohibit particulates from entering near and around an upper inner seal and a lower inner seal. In addition, when differential high pressure is simultaneously and dynamically applied to both sides of the seal system, low friction between the seal system and the shaft is continuously maintained. In this case, high pressure is greater than 1500 psi and dynamic differential high pressure means that there is normally a small pressure difference between the high pressure on one side of the seal system and that of the other side of the seal system. This small dynamic differential pressure difference could be as little as 1 psi upon activation of the FMD and could eventually reach a high pressure (1500 psi or more) during the activation process. This system accomplishes the required tasks (particulate removal, low friction between seal and shaft, and maintaining the low friction at high pressure) for all dynamically applied pressure ranges to both the upper and lower sides of the seal system for the actuator (bell housing) of the flow modulating device. The flow modulating device is a hydraulically amplified servo valve acting within a defined fluid environment.

One embodiment of the outer seal particulate barrier system includes the use of outer seals that prohibit fluid particulates greater than or less than the tolerances of the inner seals.

An additional embodiment is that the flow modulating device may be oriented within a principal fluid flow channel in any direction and at any angle.

An additional embodiment includes a seal system that employs at least two outer seals having at least two seal surfaces capable of mating with a shaft mating surface and sealing between the actuator mating surface and the shaft mating surface.

A further embodiment that describes one alternative design and method for the seal system includes providing the seals on and around the outside of the actuator without the need for a shaft to allow the actuator to open and close in the presence of particulates.

An additional embodiment includes a seal system providing for a flow modulating device allowing for continuous generation of pulses or forces.

Additionally an embodiment of the present disclosure includes positioning the flow modulating device at any angle within a pipe or pipeline so that it can act as servo valve wherein a small pressure or force activates a smaller (pilot) part which then acts upon and activates or urges a larger part to act upon a larger pressure or force.

An additional embodiment provides for the seal system which allows for a flow modulating device to act as a flow throttling device for stopping the flow of fluid within a pipeline.

Another embodiment involving the seal system of the present disclosure allows for movement of a flow modulating device in a linear movement axially on a mating shaft surface such that when the flow modulating device is acted upon by a pressurized fluid in a linear direction it urges the flow modulating device to move in the flow direction and the fluid containing particulates moves against an outer seal so that the particulates are kept from passing through the outer seal. In this manner, fluid with smaller particulates passes by the outer seal and urges an inner seal to expand to create a tighter seal around a specific mating surface such that the tighter seal prohibits any particulates from entering the area between the inner seal surface and in the contact with the mating surfaces.

In yet another embodiment the seals of the seal system are oriented around the shaft surface in a desired orientation to enable the flow modulating device to move axially in any direction along a shaft surface such that when the hydraulic pressure increases in one direction, the particulates in the fluid are stopped by the outer lower seal and the remaining fluid expands the inner seal to increase the force between the inner seal and the shaft thereby sealing the area between the seal and the shaft surface. When the hydraulic pressure increases in the opposite direction the particulates in the fluid are stopped by the upper outer seal and the remaining fluid expands the upper inner seal to increase the force between the inner seal and the shaft thereby again sealing the area between the seal and the shaft surface. When the hydraulic pressure decreases, the inner seal contracts thereby reducing the frictional force exerted by the seal on the shaft such that the particulates in the fluid now are flowing away from the seal.

The individual inner seals operate independently of each other in the presence of increasing pressure where the fluid is flowing exclusively in either one direction or the opposite direction.

In another embodiment the upper outer seal and the lower outer seal are comprised of a material that is wear resistant and formable to required tolerances and wherein the upper outer seat and lower outer seal are arranged so that the upper outer seal and the lower outer seal face in the direction of the applied pressure and away from each other.

In another embodiment the upper inner seal and the lower inner seal are comprised in a geometric configuration that possibly allows for more compliance and formability than the outer seals. Again, the upper inner seal and lower inner seal openings are arranged in opposite directions. The hydraulic pressure from the fluid moving in a first direction expands the inner seal wall of the first inner seal to create a pressure activated seal against a mating surface such as a shaft thereby sealing the area between the inner seal wall and the shaft surface to ensure that there is no possibility of particulates penetrating into a space between the seal wall and the shaft surface (the mated surfaces).

In another embodiment the outer seals and inner seals operate in a flow range of 10-1000 gallons/min., but can handle much larger flow or smaller flow rates, depending on the surface area that allows the fluid to flow through the FTD and the pressure drops developed across the actuator. The pressure differentials inside and outside the actuator are what causes the actuator to open and close.

The removal of fluid particulates and residual particulates by the outer seal particulate barrier system allows for clean fluid or gas to flow into the mating surfaces of the inner seals, thereby preventing contamination by particulates in a size range which would jam the operation of the inner seals.

In another embodiment the seal system is capable of operation within the range of 100 millitorr (vacuum) to 1500 pounds per square inch such that the pressure is a measurable pressure drop of the fluid acting on the upper outer seal or upper inner seal. The seals of the FMD operate over a wide pressure range from a vacuum to several thousand psi.

The fluid flow rate through the FMD will assist in determining the size of the actuator. The seal system residing within the actuator allows for movement of the actuator in milliseconds as well as allowing for modulation of the fluid flow. The control of the movement of the actuator can be modified by varying different parameters within the FMD such as increasing the size of the actuator, the size and geometry of any orifices allowing fluid into or out of the interior or exterior of the actuator, resulting in increasing or decreasing the pressure drop through the actuator.

For example, the seals of the FMD could be a fluoroelastomer moving against tungsten carbide. The outer seals are wipers to exclude particulates and the inner seals are pressure activated.

DETAILED DESCRIPTION OF THE DRAWINGS

Figure 1:
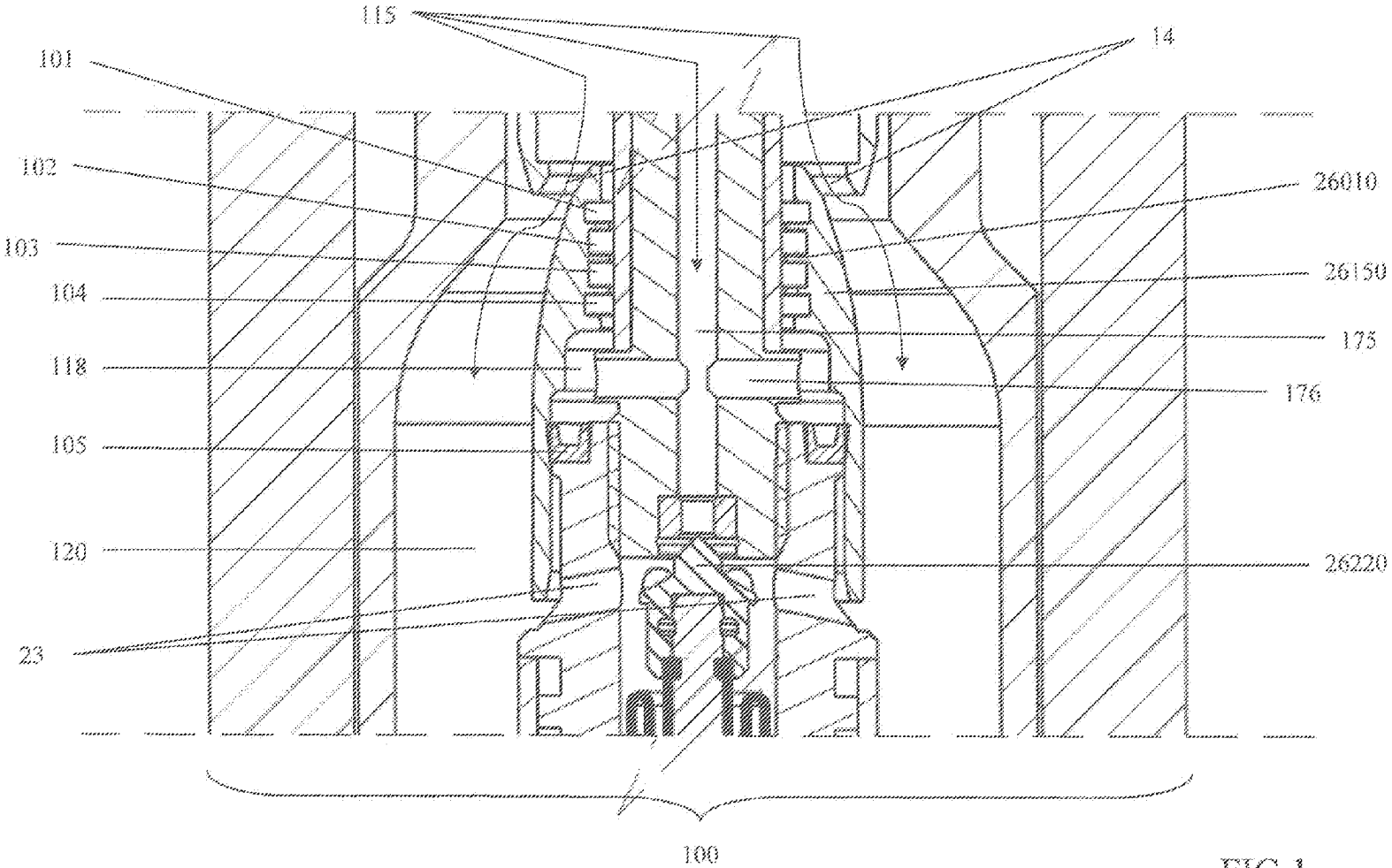
FIG. 1 describes an FTD/FMD actuator system operation.

FIG. 1 shows the FMD valve assembly [100]. The fluid [115] which may be clean (particulate free) or dirty (with particulates as described previously) passes through FMD orifice [14] and continues out of the FMD through lower flow path [120]. FMD orifice [14] is modulated by FMD actuator [26150] which causes pressure to be imparted into the fluid [115] which is constrained. The rate of fluid flow influences the rate of pressure change. Fluid [115] flow in the guide pole channel [175] is controlled by a pilot valve [26220], and connected to FMD actuator [26150] through connecting channels [176]. When pilot valve [26220] is open, fluid [115] exits through channnels [23] relieving the inner pressure from the volume of fluid [115] within an inner chamber [118] between the FMD actuator [26150] body and the shaft [26010] through channels {176, 175] and eventually out of channel [23] into the lower outer flow channel [120]. Thus the FMD actuator [26150] is pushed open by fluid [115] through the FMD orifice [14].

When pilot valve [26220] closes, pressure increases to internal chamber [118] of FMD actuator [26150] through connecting channels [176], moving FMD actuator [26150] to modulate and close the flow of fluid [115] through FMD orifice [14]. The upper outer seal [101], upper inner seal [102], lower inner seal [103], lower outer seal [104] and rear seal [105] allow FMD actuator [26150] to move and keep fluid [115] constrained within the internal chamber [118].

Upper outer seal [101] and lower outer seal [104] exclude large particulates from entering into the space where the upper inner seal [102] and lower inner seal [103] reside. The upper outer seal [101] and lower outer seal [104] do not support a pressure load and allow a small amount of fluid [115] to bypass while excluding particulates from entering the area around the upper inner seal [102] and lower inner seal [103]. This eliminates pressure locking between the inner seals [102, 103] and the outer seals [101, 104]. By excluding the particulates from entering into the space where the inner seals reside [102, 103] the seals are protected and the clearances of the inner seals [102, 103] can be reduced to support high pressure loads. Very small particulates can bypass the outer seals [101, 104], but the particulates must be very small in relative to the clearances of the inner seals [102, 103] to penetrate the space between the outer seals [101, 104] and inner seals [102, 103].

Figure 2:
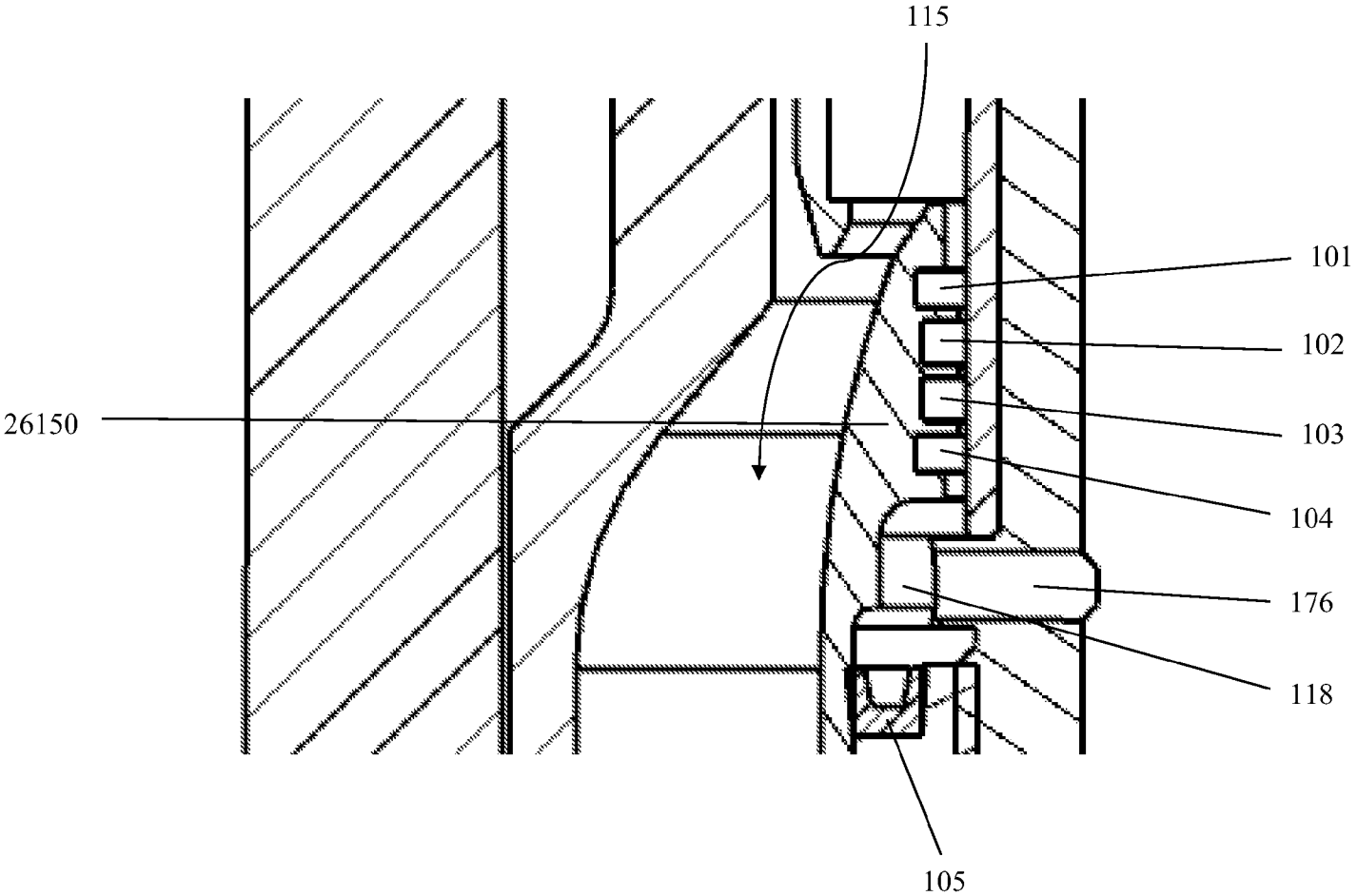
FIG. 2 is a detailed cross section of the seals.

FIG. 2 shows a detailed configuration of the internal chamber [118], the FMD actuator [26150], the upper outer seal [101], upper inner seal [102], lower inner seal [103], lower outer seal [104] and rear seal [105] and the flow of fluid [115] through the inner chamber [118] and the connecting channels [176]. The inner seals [102, 103] support the high pressure operation of the FMD actuator [26150].

Figure 3:
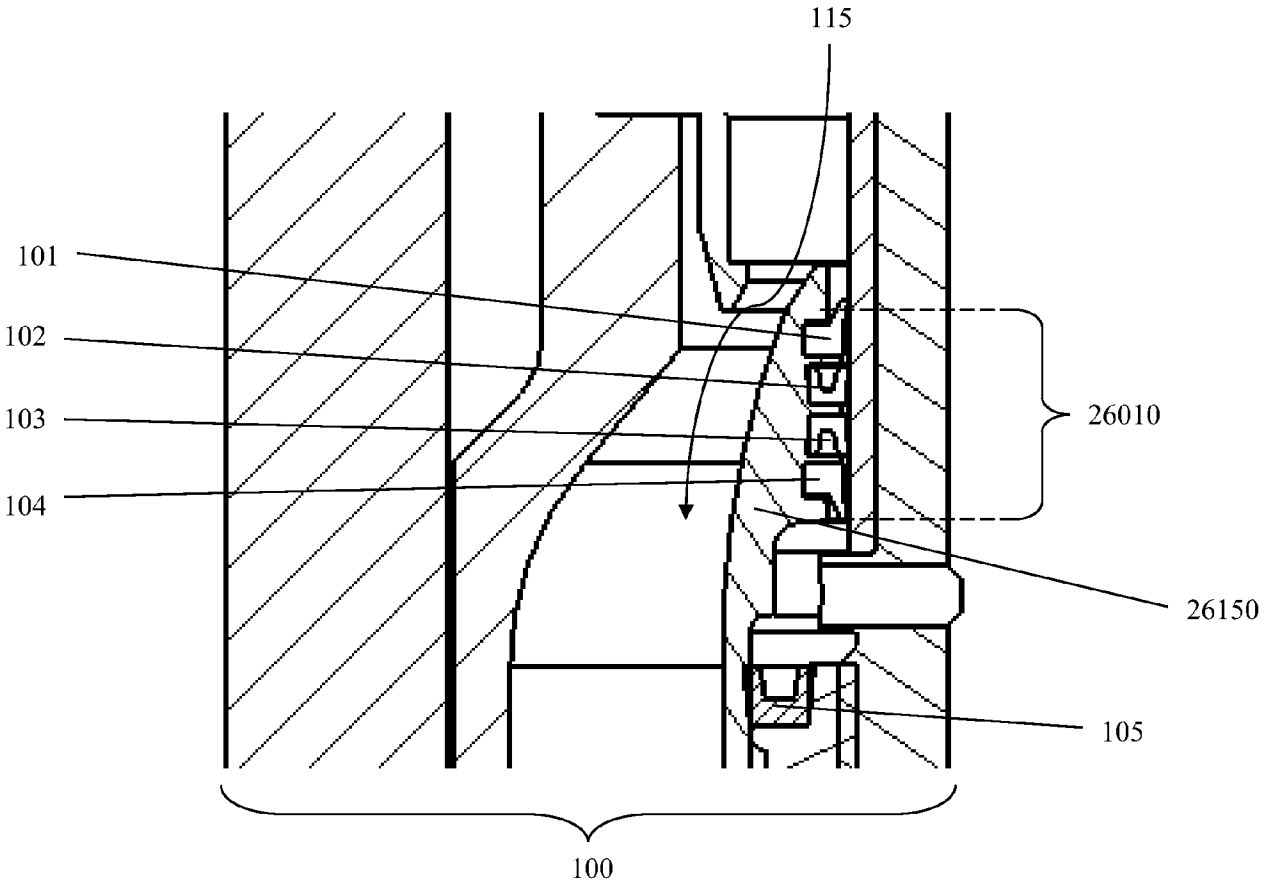
FIG. 3 describes the seals, orientation, relationships and operation of the device.

FIG. 3 shows the inner seals [102, 103] schematically as pressure activated "U" seals and the outer seals [101, 104] are schematically depicted as "angled scrapers". Each inner seal [102, 103] and outer seal [101, 104] operate to seal preferentially in one direction. The inner seals [102, 103] are situated "back to back" away from each other in that the upper inner seal [102] has the open "U" portion facing upwardly and the lower inner seal [103] facing with the open "U" downwardly. Upper inner seal [102] activates when pressure is applied to the upper section of the FMD actuator [26150]. Lower inner seal [103] activates when pressure is applied to the lower, internal part of the FMD actuator [26150].

Figure 4:
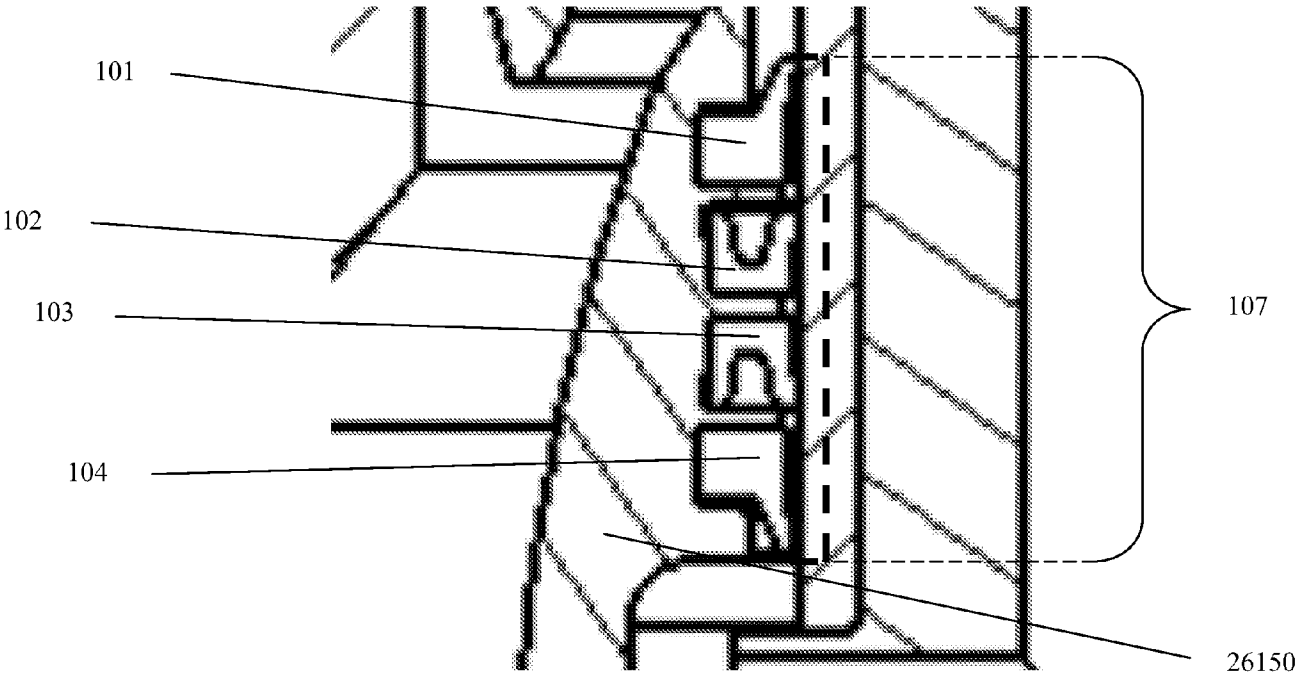
Figure 5:
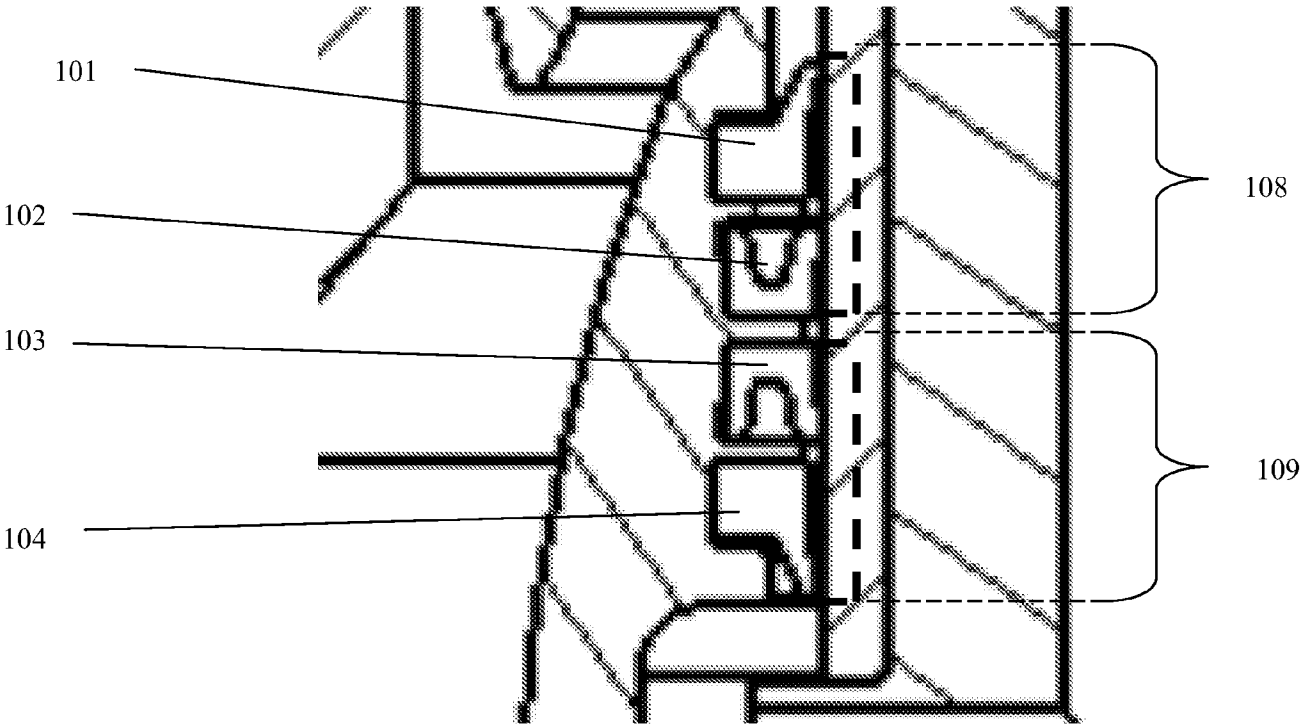

FIG. 4 provides a close-up view of all seals, to include the upper outer seal [101], the upper inner seal [102], the lower inner seal [103], and the lower outer seal [104], acting in combination as a single sealing unit [107], FIG. 5 provides an additional close-up view of all seals, to include the upper outer seal [101], the upper inner seal [102], the lower inner seal [103], and the lower outer seal [104], where the upper outer seal [101] and the upper inner seal [102] are combined into an upper seal single unit [108]. Wherein the upper the seals are combined into an upper seal single unit [108], conversely the lower inner seal [103] and the lower outer seal [104] can be combined into a lower seal single unit [109].

When the inner seals [102, 103] are activated they also support the outer seals [101, 104] through fluid trapped between any tolerances that exist between the inner seals [102, 103] and the outer seals [101, 104]. When the fluid [115] pressure is reduced on the upper outer seal [101] and upper inner seal [102] the fluid [115] buildup between the upper outer seal [101] and upper inner seal [102] escapes past the upper outer seal [101] and upper inner seal [102] avoiding any pressure lock conditions. Conversely, when the fluid [115] pressure is reduced on the lower inner seal [103] and lower outer seal [104] the drilling fluid [115] buildup between the lower inner seal [103] and lower outer seal [104] escapes past the lower inner seal [103] and lower outer seal [104] again avoiding any pressure lock conditions. The structure, which includes the internal clearance between the actuator [26150] and the shaft [26010] under a large mechanical pressure load from the fluid [115], should include a clearance which is in the same size range as some of the smallest particulates (from 0.001 inches to 0.200 inches found in a dirty fluid [115]. Without the outer seals [101, 104] excluding the particulates from the inner seals [102, 103], the inner seals would jam due to particulates getting into the small clearance areas required for the inner seals [102, 103] to support the high pressure loads. Testing has shown the jam condition is unique to the front portion of the FMD valve assembly [100] which has a high pressure applied from both sides simultaneously at both the outer seals [101, 104] and the inner seals [102, 103] position(s). The rear seal [105] does not experience the same jam conditions due to pressure being applied from one side only. The particulates are cleared away from the rear seal [105] on each successive upward and downward cyclic operation of the FMD actuator [26150].

Additionally the upper outer seal [101], upper inner seal [102], lower inner seal [103], lower outer seal [104] may be of various sealing material compositions and have various shapes. The upper outer seal [101], upper inner seal [102], lower inner seal [103], lower outer seal [104] may be combined into a single sealing system with integral wiping, sealing, and support. structures. Alternately, the upper outer seal [101] and upper inner seal [102] may be combined into a single unit and the lower inner seal [103] and lower outer seal [104] may be combined into a single unit and stacked accordingly in relationship to each other. The upper outer seal [101] and upper inner seal [102], lower inner seal [103] and lower outer seal [104] may be of other mechanical geometries to provide the same functionality, such as outer seals being a ring, ring stack, or packing, and inner seals being pre-loaded, "T" seals, or "V" seals.

The important factors in this design include:

a) the outer seals [101, 104] are designed to exclude particulates within a fluid that are particulates with a size range that could jam the inner seals [102, 103]

b) the inner seals must function independently [102, 103] in the presence of high pressure. The seals may be preloaded such that when the pressure first acts on the inner seals, the inner seals are activated and expand into place to stop fluid from leaking through into any space between the inner seals and the (shaft) mating surface. In order to function properly, it is necessary to ensure low enough pliability of these inner seals (low compliance materials must be used) which equates to low friction between the shaft and the seals in the presence or absence of particulates that may still exist in the fluid flow. Most of the particulates will be prevented from entering this space by the outer seals. The support structure for the seal has to have sufficiently small clearance to prevent the seal from extruding past the support structure and the clearance must be large enough not to allow jamming from particulates. The seal is designed to be a zero clearance seal, therefore as the pressure is increased the seal is completed. In this regard, another feature that can exist for the inner seals is the use of "back-up rings" or washers that are optionally split and are placed behind the inner seals such that failure due to extrusion of the seals themselves is severely limited. This allows the operating pressure of the system to be increased without changing the clearance. The use of these "back-up rings" or washers could be substituted for or used in lieu of the inner seals. The overall fluid pressure pressurizes the seal as opposed to conventional mechanical sealing where, with mechanical sealing, the particulates would cause interference between the shaft and the seal thereby increasing friction and leading to eventual failure.

c) The outer seals act as wiping seals in that they provide for scraping or wiping away of particulates by providing a sealing action between the outer seals and the inner seals and the shaft. The inner seals are designed as pressure activated seals and are designed to be compliant—the particulates will ruin the pressure seals and make them inoperable.

d) the inclusion of clearance for the inner seals [102, 103] so particulates cannot jam or bypass the outer seals [101, 104].

It will, of course, be appreciated that the embodiment which has just been described has been given simply by the way of illustration, and the invention is not limited to the precise embodiments described herein; various changes and modifications may be effected by one skilled in the art without departing from the scope or spirit of the invention as defined in the appended claims.

We claim:

1. An apparatus comprising one or more devices capable of modulating fluid flow, said fluid being a liquid or a gas resulting in a pressure fluctuation in a fluid flowing within a flow channel, comprising: a flow modulating device that acts as a servo valve, said device comprising a shaft and a moveable actuator that slides along said shaft, wherein said shaft and said actuator are positioned at a 90 degree angle within a principal fluid flow channel such that the fluid flows through said principal fluid flow channel and such that fluid flowing within said principal fluid flow channel also allows for fluid flow within both an inner pilot flow channel and said principal fluid flow channel, wherein said actuator comprises an upper outer seal and a lower outer seal, an upper inner seal and an lower inner seal, wherein said upper outer seal and said lower outer seal prohibit fluid particulates from entering said upper inner seal and said lower inner seal respectively and wherein said inners seals are situated back to back away from each other in that said upper inner seal has an upper "U" shaped portion facing upwardly and said lower inner seal has a "U" shaped portion facing downwardly so that said upper inner seal and said lower inner seal function independently in the presence of elevated pressure and wherein said upper inner seal and said lower inner seal is preloaded such that when pressure first acts on said upper inner seal and said lower inner seal both inner seals are activated and expand into place stopping fluid from leaking through into the space between said upper inner seal and said lower inner seal and a shaft mating surface and wherein a seal support structure for both inner seals must include a clearance between both inner seals and said shaft that prevents said inner seals from being deformed and squeezed into the space between said seal support structure and said shaft, wherein said clearance must prevent jamming due to said fluid particulates, but also provide and allow for axial movement of said inner seals along said shaft and wherein said upper inner seal, said lower inner seal, said upper outer seal and said lower outer seal is combined into a single sealing system and/or alternatively said upper outer seal and upper inner seal may be combined into a single unit and said lower inner seal and said lower outer seal may be combined into a single unit.

2. The apparatus of claim 1, wherein for said seal system to function properly it is necessary to ensure sufficient pliability of both inner seals so that friction is reduced between said shaft and said seals allowing for complete functionality of said actuator in the presence of said fluid particulates.

3. The apparatus of claim 1, wherein said both inner seals are designed to exhibit zero clearance between said both inner seals and said shaft in that as the pressure is increased the actual sealing between said inner seals and said shaft is completed.

4. The apparatus of claim 1, wherein said both inner seals include the use of back-up rings or split washers placed at the base of said inner seals such that failure due to deformation of said inner seals is reduced, allowing operating pressure of the system to be increased without causing a change in said clearance between said both inner seals and said shaft.

5. The apparatus of claim 1, wherein use of said back-up rings or washers are substituted for one or more inner seals.

6. The apparatus of claim 1, wherein said outer seals act as wiping seals in that they provide for scraping or wiping away of said fluid particulates by providing a sealing action between both outer seals and said both inner seals.

7. The apparatus of claim 1, wherein said seal system is provided for said flow modulating device allowing for continuous generation of pulses or forces.

8. The apparatus of claim 1, wherein a pipe or pipeline valve within a fluid channel exists that is positioned at a 90 degree angle so that it can act as a servo valve, wherein said servo valve comprises a pilot actuation system selected from the group consisting of; hydraulic, electrical and mechanical driven mechanisms to functionally operate said servo valve.

9. The apparatus of claim 1, wherein said seal system includes outer seals prohibiting fluid particulates of a size less than a clearance between said flow actuator and said shaft modulating device from entering into said clearance.

10. The apparatus of claim 1, wherein said flow modulating device is used as a pulse generating device.

11. The apparatus of claim 10, wherein said flow modulating device is a flow throttling device.

12. The apparatus of claim 1, wherein said seal system includes removal of fluid particulates and residual particulates by allowing clean fluid into mating surfaces of said actuator and said shaft during each pulse cycle, thereby preventing contamination by any said fluid particulates or said residual particulates.

13. The apparatus of claim 1, wherein said particulate barrier system is capable of operation within a range of 100 millitorr to no less than 1500 pounds per square inch wherein said pressure is a measured pressure drop of said fluid acting on said upper outer seal and said upper inner seal.

14. The particulate barrier system of claim 13, wherein said system is actuated in milliseconds and modulates said pressure drop with precision and accuracy to within 5 percent of a desired said measured pressure drop.

15. The particulate barrier system of claim 14 wherein said system includes providing a barrier for fluid or gas particulates present during the process of seismic pulse generation, drilling, fracturing, or injecting fluids and/or gas into a well bore or pipeline.

16. The particulate barrier system of claim 15, wherein said system includes providing said barrier for hydrocarbon fluids or gases that are removed from a well bore or pipeline.

17. A method for using an apparatus comprising: one or more devices capable of modulating fluid flow, said fluid being a liquid or a gas resulting in a pressure fluctuation in a fluid flowing within a flow channel, further comprising the steps of: using a flow modulating device that acts as a servo valve, said device comprising a shaft and a moveable actuator that slides along said shaft, wherein said shaft and said actuator are positioned at a 90 degree angle within a principal fluid flow channel such that the fluid flows through said principal fluid flow channel and such that fluid flowing within said principal fluid flow channel also allows for fluid flow within both an inner pilot flow channel and said principal fluid flow channel, using said actuator that comprises an upper outer seal and a lower outer seal, an upper inner seal and an lower inner seal, wherein said upper outer seal and said lower outer seal prohibit fluid particulates from entering said upper inner seal and said lower inner seal respectively and ensuring said inners seals are situated back to back away from each other in that said upper inner seal has an upper "U" shaped portion facing upwardly and said lower inner seal has a "U" shaped portion facing downwardly further ensuring that said upper inner seal and said lower inner seal function independently in the presence of elevated pressure and preloading said upper inner seal and said lower inner seal such that when pressure first acts on said upper inner seal and said lower inner seal both inner seals are activated and expand into place stopping fluid from leaking through into the space between said upper inner seal and said lower inner seal and a shaft mating surface and providing clearance for a seal support structure for both inner seals between both inner seals and said shaft that prevents said inner seals from being deformed and squeezed into the space between said seal support structure and said shaft, wherein said clearance must prevent jamming due to said fluid particulates, but also providing and allowing for axial movement of said inner seals along said shaft and wherein said upper inner seal, said lower inner seal, said upper outer seal and said lower outer seal is combined into a single sealing system and/or alternatively said upper outer seal and upper inner seal is combined into a single unit and said lower inner seal and said lower outer seal is combined into a single unit.

18. The method of claim 17, wherein for said seal system to function properly it is necessary to ensure sufficient pliability of both inner seals so that friction is reduced between said shaft and said seals allowing for complete functionality of said actuator in the presence of said fluid particulates.

19. The method of claim 17, wherein said both inner seals are designed to exhibit zero clearance between said both inner seals and said shaft in that as the pressure is increased the actual sealing between said inner seals and said shaft is completed.

20. The method of claim 17, wherein said both inner seals includes the use of back-up rings or split washers and are placed at the base of said inner seals such that failure due to deformation of said inner seals is reduced, allowing operating pressure of the system to be increased without causing a change in said clearance between said both inner seals and said shaft.

21. The method of claim 17, wherein use of said back-up rings or washers are substituted for one or more inner seals.

22. The method of claim 17, wherein said outer seals act as wiping seals in that they provide for scraping or wiping away of said fluid particulates by providing a sealing action between said both outer seals and said both inner seals.

23. The method of claim 17, wherein said seal system and said flow modulating device allows for continuous generation of pulses or forces.

24. The method of claim 17, wherein a pipe or pipeline valve within a fluid channel exists and is positioned at a 90 degree angle and is acting as a servo valve, wherein said servo valve comprises a pilot selected from the group consisting of; hydraulic, electrical and mechanical driven mechanisms to functionally operate said servo valve.

25. The method of claim 17, wherein said seal system includes outer seals prohibiting fluid particulates of a size less than a clearance between said flow actuator and said shaft modulating device from entering into said clearance.

26. The method of claim 17, wherein using said flow modulating device as a pulse generating device occurs.

27. The method of claim 26, wherein said flow modulating device is a flow throttling device.

28. The method of claim 17, wherein said seal system includes removing fluid particulates and residual particulates by allowing clean fluid into mating surfaces of said actuator and said shaft during each pulse cycle, thereby preventing contamination by any said fluid particulates or said residual particulates.

29. The method of claim 17, wherein said seal system is capable of operating within a range of 100 millitorr to no less than 1500 pounds per square inch and wherein said pressure is a measured pressure drop of said fluid acting on said upper outer seal and said upper inner seal.

30. The seal system of claim 29, wherein actuating said system within milliseconds and also modulating said pressure drop with precision and accuracy to within 5 percent of a desired said measured pressure drop is accomplished.

31. A particulate barrier system comprising an apparatus for modulating fluid flow such that a flow modulating device acts as a servo valve, said flow modulating device comprising a shaft and a movable actuator that slides along said shaft, wherein said shaft and said actuator are positioned at a 90 degree angle within a principal fluid flow channel such that when fluid flows through said principal fluid flow channel including said particulate barrier system, said particulate barrier system comprising at least one seal system for said actuator such that an upper outer seal and a lower outer seal act as wipers or scrapers prohibiting particulates from entering near and around an upper inner seal and a lower inner seal wherein said seal system comprises an upper outer seal and a lower outer seal, an upper inner seal and an lower inner seal, wherein said upper outer seal and said lower outer seal prohibit fluid particulates from entering said upper inner seal and said lower inner seal respectively and wherein said inner seals are situated back to back away from each other in that said upper inner seal has an upper "U" shaped portion facing upwardly and said lower inner seal has a "U" shaped portion facing downwardly so that said upper inner seal and said lower inner seal function independently in the presence of elevated pressure and wherein said upper inner seal and said lower inner seal is preloaded such that when pressure first acts on said upper inner seal and said lower inner seal both inner seals are activated and expand into place stopping fluid from leaking through into the space between said upper inner seal and said lower inner seal and a shaft mating surface and wherein a seal support structure for both inner seals must include a clearance between both inner seals and said shaft that prevents said inner seals from being deformed and squeezed into the space between said seal support structure and said shaft, wherein said clearance must prevent jamming due to said fluid particulates, but also provide and allow for axial movement of said inner seals along said shaft and wherein said upper inner seal, said lower inner seal, said upper outer seal and said lower outer seal is combined into a single sealing system and/or alternatively said upper outer seal and upper inner seal may be combined into a single unit and said lower inner seal and said lower outer seal may be combined into a single unit.

32. The system of claim 31, wherein sufficient pressure to ensure no particulate contamination of said barrier system is greater than 1500 pounds per square inch and a dynamic differential high pressure is normally a small pressure difference between said sufficient pressure on one side of said seal system and that of the other side of said seal system such that a small dynamic differential pressure difference is between 1 pound per square inch and at least 1500 pounds per square inch during any functional activation process wherein said actuator moves and remains functional for all dynamically applied pressure ranges to applied to any side of said seal system.

33. The particulate barrier system of claim 32, wherein said particulate barrier system is capable of operation within a range of 100 millitorr to no less than 1500 pounds per square inch wherein said pressure is a measured pressure drop of said fluid acting on said upper outer seal and said upper inner seal.

34. The particulate barrier system of claim 33, wherein said system is actuated in milliseconds and modulates said pressure drop with precision and accuracy to within 5 percent of a desired pressure drop.

35. The particulate barrier system of claim 33, wherein said system includes providing a barrier for fluid or gas particulates present during the process of seismic pulse generation, drilling, fracturing, or injecting fluids and/or gas into a well bore or pipeline.

36. The particulate barrier system of claim 33, wherein said system includes providing a barrier for hydrocarbon fluids or gases that are removed from a well bore or pipeline.

* * * * *